US006065820A

United States Patent [19]

Fleissner et al.

[11] Patent Number: 6,065,820

[45] Date of Patent: May 23, 2000

[54] HOUSEHOLD APPLIANCE WITH FRONT PANEL

[75] Inventors: Reinhard Fleissner, Altenmarkt; Gerhard Busalt, Traunreut, both of Germany

[73] Assignee: BSH Bosch und Siemens Hausgeraete GmbH, Munich, Germany

[21] Appl. No.: 09/182,277

[22] Filed: Oct. 29, 1998

[30] Foreign Application Priority Data

Oct. 29, 1997 [DE] Germany ..... 197 47 769

[51] Int. Cl.[7] ..... F24C 7/08

[52] U.S. Cl. ..... 312/265.5; 312/265.6; 312/236

[58] Field of Search ..... 312/204, 265.5, 312/265.6, 279, 223.1, 228, 236; 126/42, 211, 214 R, 214 A

[56] References Cited

U.S. PATENT DOCUMENTS

| | | | |
|---|---|---|---|
| 2,013,802 | 9/1935 | Hobson | 126/42 |
| 3,294,461 | 12/1966 | Barnard et al. | 312/204 |
| 4,798,424 | 1/1989 | Coates et al. | 312/279 |
| 5,375,921 | 12/1994 | Tupa et al. | 312/279 |

FOREIGN PATENT DOCUMENTS

| | | | |
|---|---|---|---|
| 0 388 728 A2 | 9/1990 | European Pat. Off. . | |
| 388375 | 9/1990 | European Pat. Off. | 126/42 |
| 2 527 016 | 11/1983 | France . | |
| 8706669 | 8/1987 | Germany . | |
| 99/22177 | 5/1999 | WIPO . | |

*Primary Examiner*—Ira S. Lazarus
*Assistant Examiner*—Sara Clarke
*Attorney, Agent, or Firm*—Herbert L. Lerner; Laurence A. Greenberg; Werner H. Stemer

[57] ABSTRACT

A household appliance, such as an oven, with a front panel which extends substantially across the width of the front side of the household appliance. Control and/or display elements of the household appliance are assigned to the front panel. The front panel is an extruded metal section. In order to increase the stability of the front panel, the front panel extends, bent essentially uniformly about a vertical axis, over the width of the front panel in the shape of a segment of a cylindrical wall.

7 Claims, 3 Drawing Sheets

HOUSEHOLD APPLIANCE WITH FRONT PANEL

BACKGROUND OF THE INVENTION

FIELD OF THE INVENTION

The present invention relates to a household appliance, such as a stove or oven, with a front panel which extends essentially across the width of the front side of the household appliance, which is formed by an extruded section component made of metal and is attached to the household appliance, and control and/or display elements of the household appliance which are assigned to the front panel.

Such a household appliance is known from the German Utility Model G 87 06 669. The front panel that is implemented as an extruded section is mounted on the upper side of an electric oven in a position which is slightly inclined with respect to the vertical. The front panel has on both sides a guide track for panel components which are described below, and upper and lower horizontal groove-like guide elements which bound the aforementioned guide track. In addition, the front panel has on the underside an integrally formed attachment flange and on the upper side a likewise integrally formed flange-like projection which has a downwardly opened suspension groove and, adjacent thereto, a water collection conduit. A front panel made of a glass-like plastic which has transparent display panels in the region of windows and can have symbols or the like printed on it in this region can be inserted into the guide elements along the guide track of the front panel. A disadvantage with that electric oven is that when it is lifted by its front panel, for example during transportation or when the oven is being installed, the front panel may be damaged.

SUMMARY OF THE INVENTION

It is accordingly an object of the invention to provide a household appliance with a front panel, which overcomes the above-mentioned disadvantages of the prior known devices and methods of this general type and the front panel of which exhibits increased mechanical stability.

With the foregoing and other objects in view there is provided, in accordance with the invention, a household appliance, such as an oven, comprising:

- a front panel attached to the front side of the household appliance and extending substantially across the width of the front side;
- control and/or display elements of the household appliance assigned to the front panel;
- wherein the front panel is an extruded metal section component, bent substantially uniformly over the given width of the front side about a vertical axis.

In accordance with an added feature of the invention, the front panel is uniformly bent in a shape of a section of a cylindrical wall.

In other words, the front panel extends, bent essentially uniformly about a vertical axis, over the width of the front panel defining the arc of a circle, i.e., an arc section of a cylindrical wall. Since experience has shown that household appliances are usually grasped and lifted or pushed by the front panel during transportation and installation, the intrinsic stability of the front panel and its secure attachment to the household appliance are particularly important. By virtue of the bent shaping of the front panel, in the first instance its stability is significantly increased in a fashion which is very simple in terms of production technology, and in the second instance additional gripping surface is made available on the underside of the front panel in order to facilitate lifting of the household appliance. Here, the additional gripping surface is advantageously made available essentially in the center of the front panel, which leads to a symmetrical application of forces in the panel during lifting. This also leads to a uniform loading of the attachment points between the household appliance and front panel, which points are frequently arranged symmetrically with respect to the central axis of the front panel. In addition, it has been found that the forwardly bent shaping of the front panel significantly reduces its temperature.

In accordance with another feature of the invention, there is provided a panel frame securing the front panel to the housing of the household appliance. In a preferred embodiment, the panel frame is a plastic frame.

In other words, the front panel is secured to a panel frame which is attached to the household appliance. The panel frame significantly extends the restricted shaping possibilities of the extruded-section front panel in terms of the provision of attachment sections in the edge regions of the front panel. In particular, it is possible to attach the front panel or its panel frame by means of horizontally arranged screws or the like. A reduction in the conduction of heat from the household appliance or its components to the front panel can be achieved when the panel frame is formed of a suitable plastic.

In accordance with an additional feature of the invention, the front side of the appliance is substantially flat, and wherein the panel frame includes at least one frame plate covering a circular segment-shaped opening formed between the housing and the outwardly bent front panel. The at least one frame plate fulfills an additional function: there is therefore no need for additional covering components to be mounted, nor for the housing of the household appliance to be shaped differently, simply because of the use of the panel bent according to the invention, than is the case in household appliances of the same type in which an unbent, flat front panel is used. The cover is particularly important in order to avoid water vapors or the like escaping from the household appliance from underneath the front panel and penetrating the region behind the front panel.

In accordance with a further feature of the invention, the panel frame and the front panel each include mutually corresponding supporting sections form-lockingly connecting the panel frame and the front panel when a vertical force is applied thereon. This increases the stability of the panel arrangement further, i.e., the panel frame and the front panel have corresponding supporting sections in which they are both connected to one another in a positively locking fashion when a force is applied in the vertical direction. As a result, a stable and reliable design of the household appliance is ensured, whereby the front panel can be gripped and lifted only by the panel frame.

In accordance with a concomitant feature of the invention, the front panel includes a panel plate at a lower end thereof that extends substantially over an entire width of the front panel, the panel plate defining a gripping space underneath the front panel at which the household appliance can be lifted up by the front panel. This ensures that an operator can grip directly under the front panel if the operator wishes to lift or move the household appliance by means of the front panel. The gripping space may also be provided only after a door underneath the front panel has been opened or removed.

Other features which are considered as characteristic for the invention are set forth in the appended claims.

Although the invention is illustrated and described herein as embodied in a household appliance with front panel, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
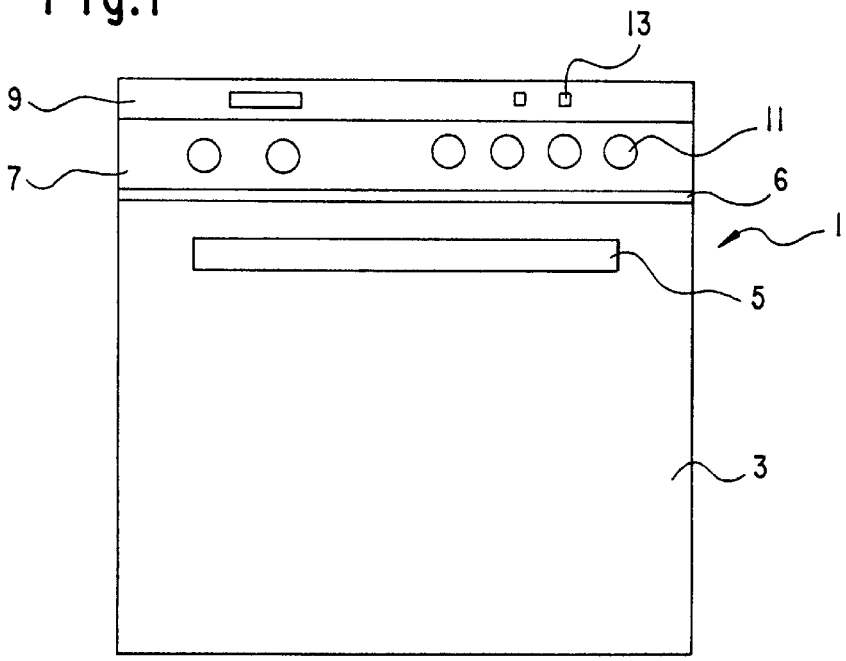
FIG. 1 is a front elevational view of a built-in oven or stove.

Referring now to the figures of the drawing in detail and first, particularly, to FIG. 1 thereof, there is seen a built-in oven 1 with an oven muffle that is closed off at the front by a door 3. The door 3 may be actuated with a bracket-shaped door handle 5 that is attached to an upper end region of the door 3 by means of two narrow webs. A front panel 7 extends above the door 3 across the entire width, leaving a narrow gripping space 6. The panel 7 is realized as an aluminum 5 extruded section component. The gripping space 6 can be increased significantly by opening or removing the door 3. A glass plate 9 is secured in the upper third of the front panel 7, as will be explained below. Control elements 11 and display elements 13 which make it possible to control and monitor the built-in oven 1 are assigned to the front panel 7 and secured therein. Non-illustrated labeling on the front panel 7 is protected by a very scratch-resistant anodized layer formed over it.

Figure 2:
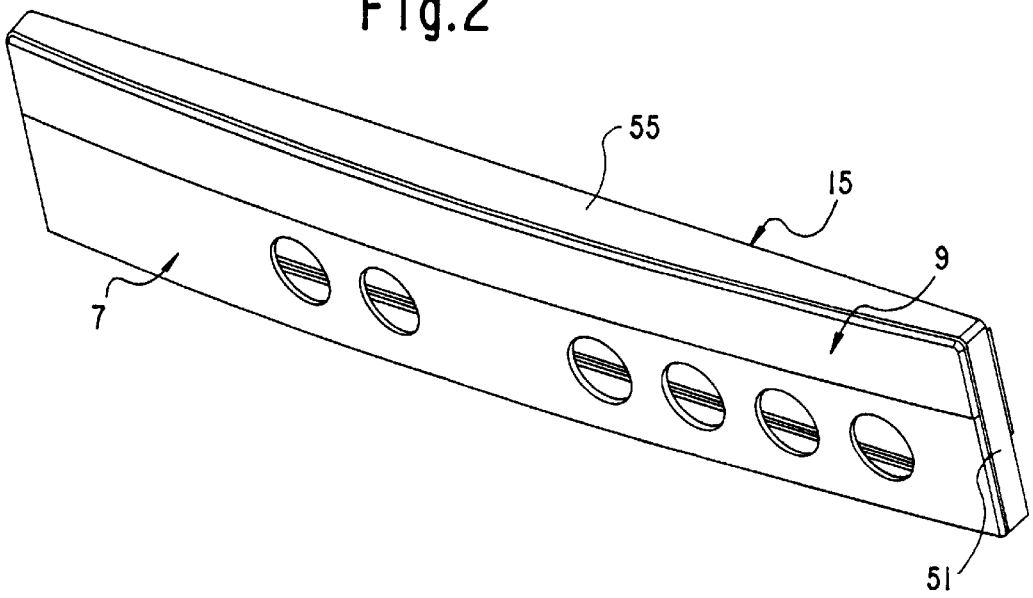
FIG. 2 is an enlarged front perspective view of the front panel with a glass plate and a panel frame.
Figure 3:
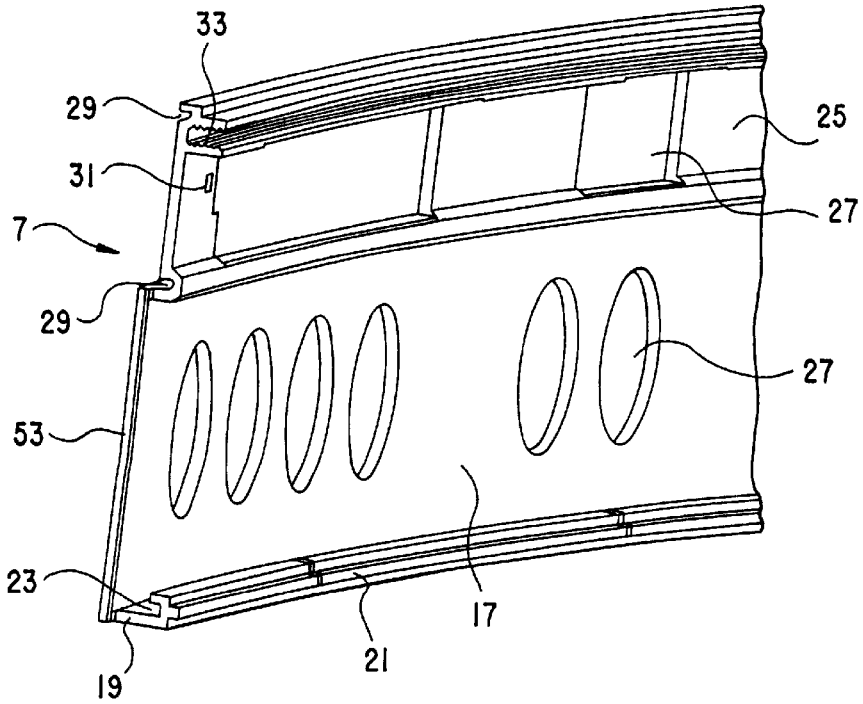
FIG. 3 is a further enlarged, partial rear perspective view of the front panel without the glass plate and without the panel frame.

Referring now to FIG. 2, the aluminum front panel 7 is attached to a panel frame 15 which is composed of fiber glass-reinforced PBT plastic. At the front, the panel frame 15 is thus covered here by the front panel 7 and the glass plate 9 so as to be virtually invisible. The front panel 7 (FIGS. 2,3) is bent uniformly over its width in the shape of a segment of a cylindrical wall with a radius of approximately 3 m. The same applies to the thin glass plate 9 after it has been mounted. The door 3 also has a corresponding shape. The front panel 7 has a control element plate 17 at whose lower end section a panel plate 19 extends at a right angle to said end section over the entire width. Provided on the panel plate 19 are a panel spring 21 and a panel groove 23 located opposite the latter. A display element plate 25 extends, slightly set back, in an upward direction from the upper end section of the control element plate 17. Suitable openings 27 for the control elements 11 and the display elements 13 are provided in said display element plate 25 and in the control element plate 17. In addition, a sealing groove 29, into which a silicone seal (not shown) is inserted (FIG. 3) between the front panel 7 and the glass plate 9 when said glass plate 9 is being mounted on the front panel 7, is also formed on the front side in the display element plate 25. In order to attach the glass plate 9, two non-illustrated latching elements are bonded to its rear side. The latching elements are capable of clipping, in a releasable fashion, with their latching hooks into latching openings 31 which are provided in the display element plate 25. This produces a sealed and firm connection between the front panel 7 and the glass plate 9. Along the upper edge, the display element plate 25 also has a screw duct 33 on the rear side. In order to attach a non-illustrated switch carrier to the front panel 7, the carrier is suspended from the panel groove 23 using appropriate means, then tilted onto the screw duct 33 and finally screwed into it.

Figure 4:
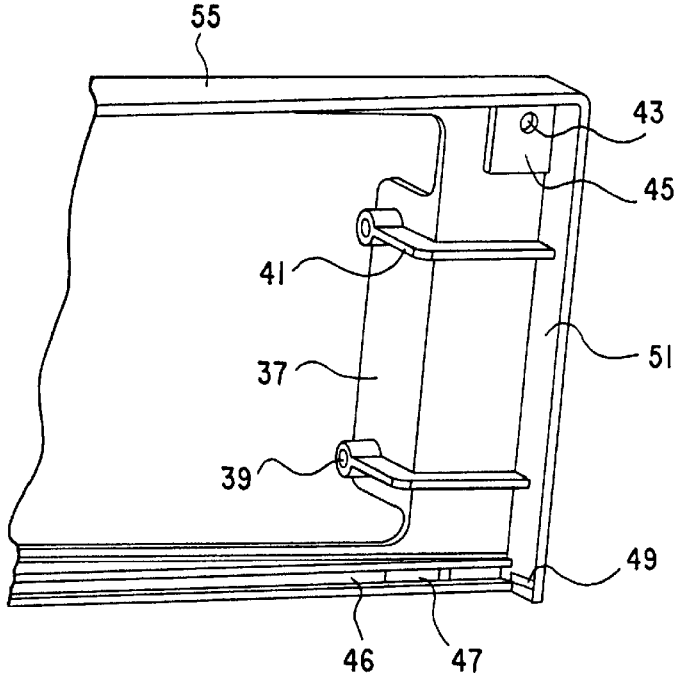
FIG. 4 is a partial, front perspective view of the panel frame.

Referring now the FIG. 4, the one-piece plastic panel frame 15 has in each of its two side regions an attachment plate 37 which protrudes from it toward the rear at a right angle and has in each case two first screw openings 39 which are arranged one on top of the other. The attachment screws for attaching the panel frame 15 to side walls or side bars (not shown) of the housing of the built-in oven 1 can be inserted through the first screw openings 39. As a result, all the forces which act on the front panel 7 are directed into the built-in oven 1 via these points. For this reason, the attachment plate 37 has in each case two horizontally extending reinforcement ribs 41. In each of the two upper corner angles of the panel frame 15 there is a second screw opening 43 for attaching the front panel 7. Each of these openings penetrates a plate-shaped projection which forms a first bearing face 45 of the panel frame 15 for the front panel 7. In the lower section, a horizontally extending frame groove 46 is provided over the entire width of the panel frame 15. Said groove 46 is interrupted in a short portion by a cut-out 47. In addition, latching hooks 49 are provided on the panel frame 15 on its forwardly projecting side wall 51 in order to attach the front panel 7 to the frame 15.

Figure 5:
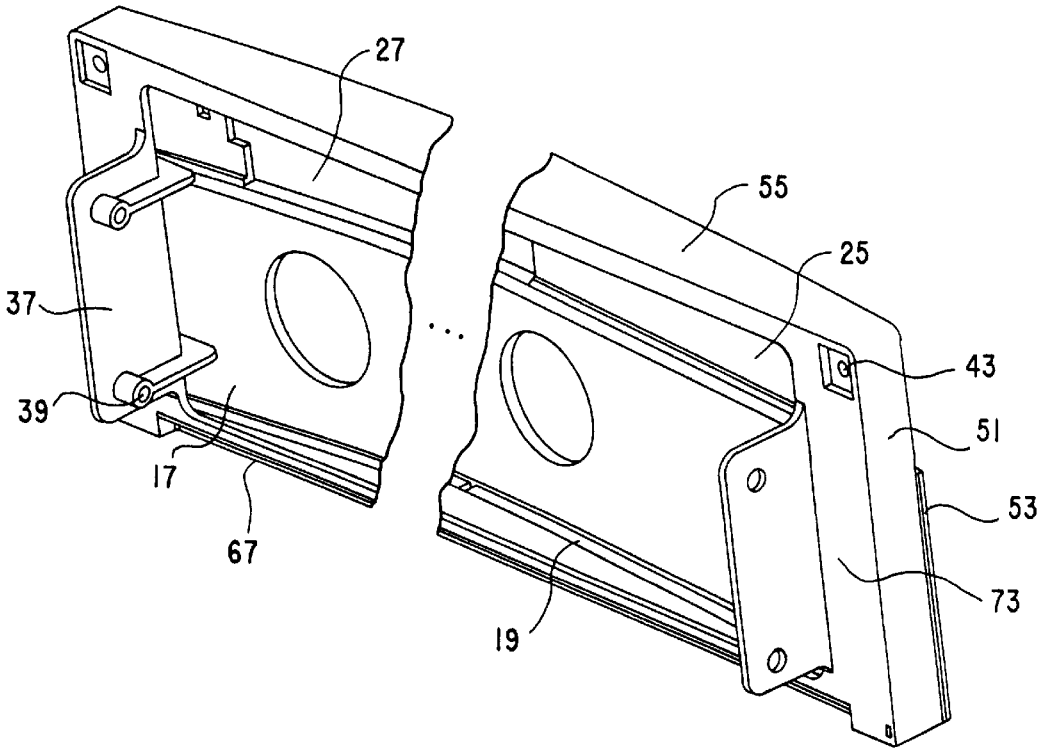
FIG. 5 is a broken, rear perspective view of the panel frame with the front panel attached thereto.

The attachment of the panel frame 15 to the panel 7 is effected as follows: the front panel 7 is plugged onto the panel frame 15. When this occurs, the panel spring 21 lies in the frame groove 46 and projects partially through the cut-out 47. The latching hooks 49 which are provided on both sides of the panel frame 15 clip into the panel groove 23. In this way, the panel frame 15 and the front panel 7 are connected to one another in a positively locking fashion over their entire width in this region, as a result of which forces which are introduced vertically into the front panel 7 can be directed into the panel frame 15 which is reinforced by the front panel 7. In the upper region the screw duct 33 of the front panel 7 lies on the first bearing face 45 of the panel frame 15. The two are screwed to one another in this region by means of screws (not shown). In the side regions and on the upper side of the front panel 7 the panel frame 15 engages around the latter. The side plate 51 of said frame 15 terminates here flush with the display element plate 25 and is covered by a panel projection 53 which is formed in each case on the side of the display element plate 25. Correspondingly, a cover plate 55 of the panel frame 15 engages over the upper side of the front panel 7. In this configuration, the circular section-shaped profile of the front edge of the cover plate 55 corresponds exactly to the curved profile of the front panel 7. A circular segment-shaped opening which is produced by the bent profile of the front panel 7 is thus covered. An appropriate design of the panel frame 15 in the region of the frame groove 46 results in the corresponding opening also being covered in this region (FIG. 5).

Figure 6:
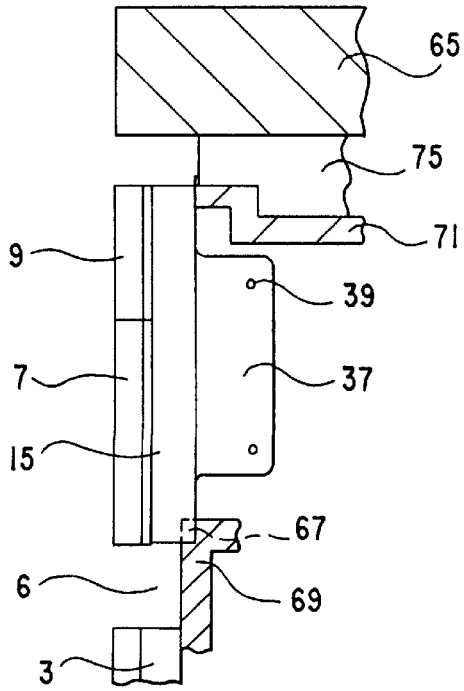
FIG. 6 is a highly simplified partial side view of a portion of the built-in oven installed under a work top.

The front panel 7 is, as explained above, attached, together with the glass plate 9, to the panel frame 15. The latter is attached in each case to the side of the housing of the built-in oven by means of screws which are inserted through the first screw openings 39. Here, in the first instance the outside of the attachment plate 37 bears against the housing (not shown). In the second instance, the panel frame 15 bears, by means of a second bearing face 67 (FIG. 5), against essentially the entire width of an oven flange 69 (FIG. 6). The built-in oven 1 is closed on the cover side by a cover plate 71 which is positioned against the panel frame 15. When it is being installed, the built-in oven 1 is pushed into an existing built-in niche to such an extent that a third bearing face 73 of the panel frame 15 and on the top side by a covertop 65 abuts respectively against the end side of an item of built-in furniture 75 which is known per se.

We claim:

1. A household appliance, comprising:

a housing having a front side with a given width;

a front panel attached to said front side and extending substantially across said given width of said front side;

control and/or display elements of the household appliance disposed on said front panel;

wherein said front panel is an extruded metal section component, bent substantially uniformly over said given width of said front side about a vertical axis.

2. The household appliance according to claim 1, wherein said front panel is uniformly bent in a shape of a section of a cylindrical wall.

3. The household appliance according to claim 1, which further comprises a panel frame securing said front panel to said housing of the household appliance.

4. The household appliance according to claim 3, wherein said panel frame is a plastic frame.

5. The household appliance according to claim 3, wherein said front side of said housing is substantially flat, and wherein said panel frame includes at least one frame plate covering a circular segment-shaped opening formed between said housing and said outwardly bent front panel.

6. The household appliance according to claim 3, wherein said panel frame and said front panel each include mutually corresponding supporting sections positively connecting said panel frame and said front panel when a vertical force is applied thereon.

7. The household appliance according to claim 1, wherein said front panel includes a panel plate at a lower end thereof and extending substantially over an entire width of said front panel, said panel plate defining a gripping space underneath said front panel for lifting the household appliance by said front panel.

* * * * *